US006863494B2

(12) United States Patent
Coppola

(10) Patent No.: US 6,863,494 B2
(45) Date of Patent: Mar. 8, 2005

(54) PROCESS GAS EXTRACTION DEVICE FOR AN AXIAL COMPRESSOR, HAVING A HIGH DEGREE OF ADAPTABILITY TO CHANGES IN THE OPERATING CHARACTERISTICS OF THE COMPRESSOR

(75) Inventor: Alessandro Coppola, Prato (IT)

(73) Assignee: Nuovo Pignone Holding S.p.A., Florence (IT)

( * ) Notice: Subject to any disclaimer, the term of this patent is extended or adjusted under 35 U.S.C. 154(b) by 30 days.

(21) Appl. No.: 10/452,902

(22) Filed: Jun. 3, 2003

(65) Prior Publication Data

US 2004/0062642 A1 Apr. 1, 2004

(30) Foreign Application Priority Data

Jun. 5, 2002 (IT) ..... MI2002A1218

(51) Int. Cl.[7] ..... F01D 11/00
(52) U.S. Cl. ..... 415/169.1; 415/220
(58) Field of Search ..... 415/169.1, 200–221, 415/58.1–58.7, 144

(56) References Cited

U.S. PATENT DOCUMENTS

| | | | | | |
|---|---|---|---|---|---|
| 3,751,909 | A | * | 8/1973 | Kohler | 60/39.17 |
| 4,157,010 | A | * | 6/1979 | Sailer | 60/774 |
| 4,981,018 | A | * | 1/1991 | Jones et al. | 60/726 |
| 5,022,224 | A | * | 6/1991 | Smith | 60/792 |
| 5,134,844 | A | * | 8/1992 | Lee et al. | 60/806 |
| 5,611,197 | A | * | 3/1997 | Bunker | 60/806 |

* cited by examiner

*Primary Examiner*—Edward K. Look
*Assistant Examiner*—James M. McAeenan
(74) *Attorney, Agent, or Firm*—Nixon & Vanderhye

(57) ABSTRACT

A process gas extraction device (10) for an axial compressor, having a high degree of adaptability to changes in the operating characteristics of the compressor; a casing (14) of the axial compressor is provided with a volute (15) for collecting process gas and the extraction device (10) comprises collecting structures (12) connected to this collecting volute (15).

15 Claims, 3 Drawing Sheets

PROCESS GAS EXTRACTION DEVICE FOR AN AXIAL COMPRESSOR, HAVING A HIGH DEGREE OF ADAPTABILITY TO CHANGES IN THE OPERATING CHARACTERISTICS OF THE COMPRESSOR

The present invention relates to a process gas extraction device for an axial compressor, having a high degree of adaptability to changes in the operating characteristics of the compressor.

As is known, axial compressors are machines to which gas is supplied in order to increase the pressure of the gas.

Axial compressors are generally machines with a plurality of stages, each stage consisting of an array of movable blades, carried by a rotor, and an array of fixed blades, carried by a stator.

The blade length generally decreases from the first to the last stage, in order to keep the axial component of the velocity of the gas sufficiently high even though its specific volume gradually decreases.

Axial compressors have the advantages of high efficiency, the capacity to compress high-volume flows with small overall dimensions, and the capacity to provide high compression ratios in a single casing with smaller overall dimensions than those of multiple-stage centrifugal compressors.

On the other hand, axial compressors are more delicate and difficult to adjust. For example, if it is necessary to upgrade or modify an axial compressor in such a way that the operating characteristics of the compressor in terms of flow rate and compression ratio have to be changed, then the stability characteristics of the machine will be modified.

In particular, the compressor may enter a state of unstable operation, in which a blade set may stall; in other words, the boundary layer may become detached from the surface of the blade. This causes the appearance of pulsations in the gas being compressed, which may even have destructive effects on the compressor itself. This state is known as the "pumping" of the compressor.

Especially during transitory states, the margin for avoiding pumping is particularly critical. To keep the margins of stable operation in conformity with the principles of robust design, it may become necessary to increase the flow rate of gas to be extracted along the length of an extraction or collection channel of the compressor, leading to difficulties in cases in which the original extraction channels have not been designed with sufficient excess capacity to meet the requirements of labelling the compressor in the unmodified version.

For example, the amount of gas extracted from a single extraction channel available to one of the final stages would be far too small to eliminate any instability in the first stages during starting.

To prevent pumping and maintain a safety margin which conforms to the principles of robust design, the solutions adopted in the prior art are the use of collecting volutes or scrolls incorporated in the casting of the casing of the axial compressor. If the operating characteristics of the compressor are modified, then in order to prevent any problems in the final stages the first stages of the compressor are modified by adding auxiliary extraction systems at the compressor outlet.

The object of the present invention is therefore to overcome the aforementioned drawbacks and in particular the problem of providing a process gas extraction device for an axial compressor which has a high degree of adaptability to a change in the operating characteristics of the compressor, without the need to incur the costs of replacing the collecting volutes, which would be necessary in the prior art.

Another object of the present invention is to provide a process gas extraction device for an axial compressor which has a high degree of adaptability to a change in the operating characteristics of the compressor, and which is particularly reliable, simple, functional and relatively inexpensive.

These and other objects according to the present invention are achieved by producing a process gas extraction device for an axial compressor which has a high degree of adaptability to a change in the operating characteristics of the compressor, as described in claim 1.

Further characteristics are described in the subsequent claims.

The characteristics and advantages of a process gas extraction device for an axial compressor which has a high degree of adaptability to a change in the operating characteristics of the compressor, according to the present invention, will be made clearer by the following description, provided by way of example and without restrictive intent, with reference to the attached schematic drawings in which FIG. 1 is a sectional plan view from above of a portion of a casing of an axial compressor, provided with a process gas extraction device according to the present invention, shown in an external view;

With reference to the figures, these show a process gas extraction device, indicated as a whole by the number 10, for an axial compressor, and in the illustrated example, according to the present invention, the device comprises collecting structures 12, connected to a collecting volute 15, which is of the type known in the art and which is formed by casting integrally with a casing 14 of the axial compressor.

Figure 1:
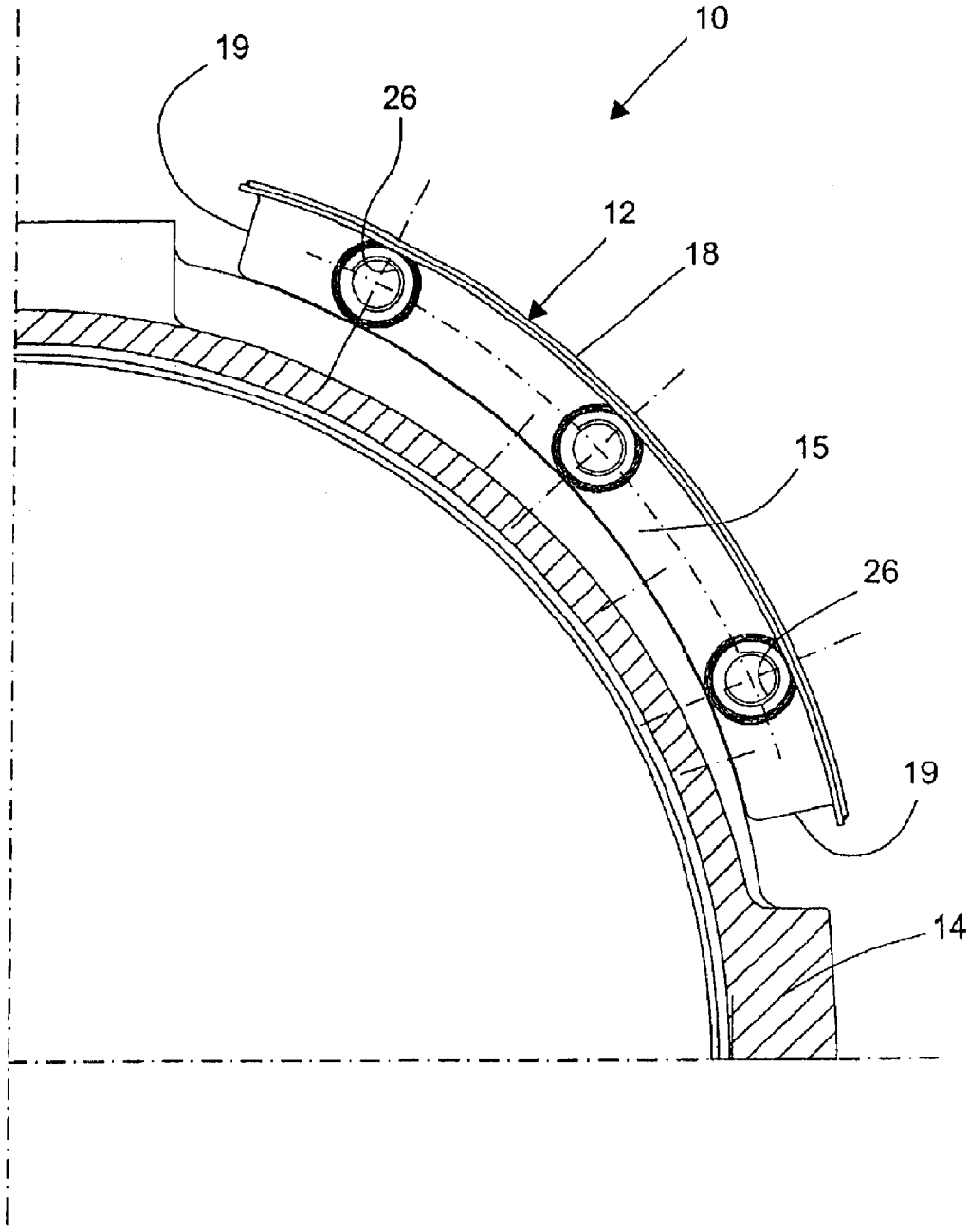
Figure 2:
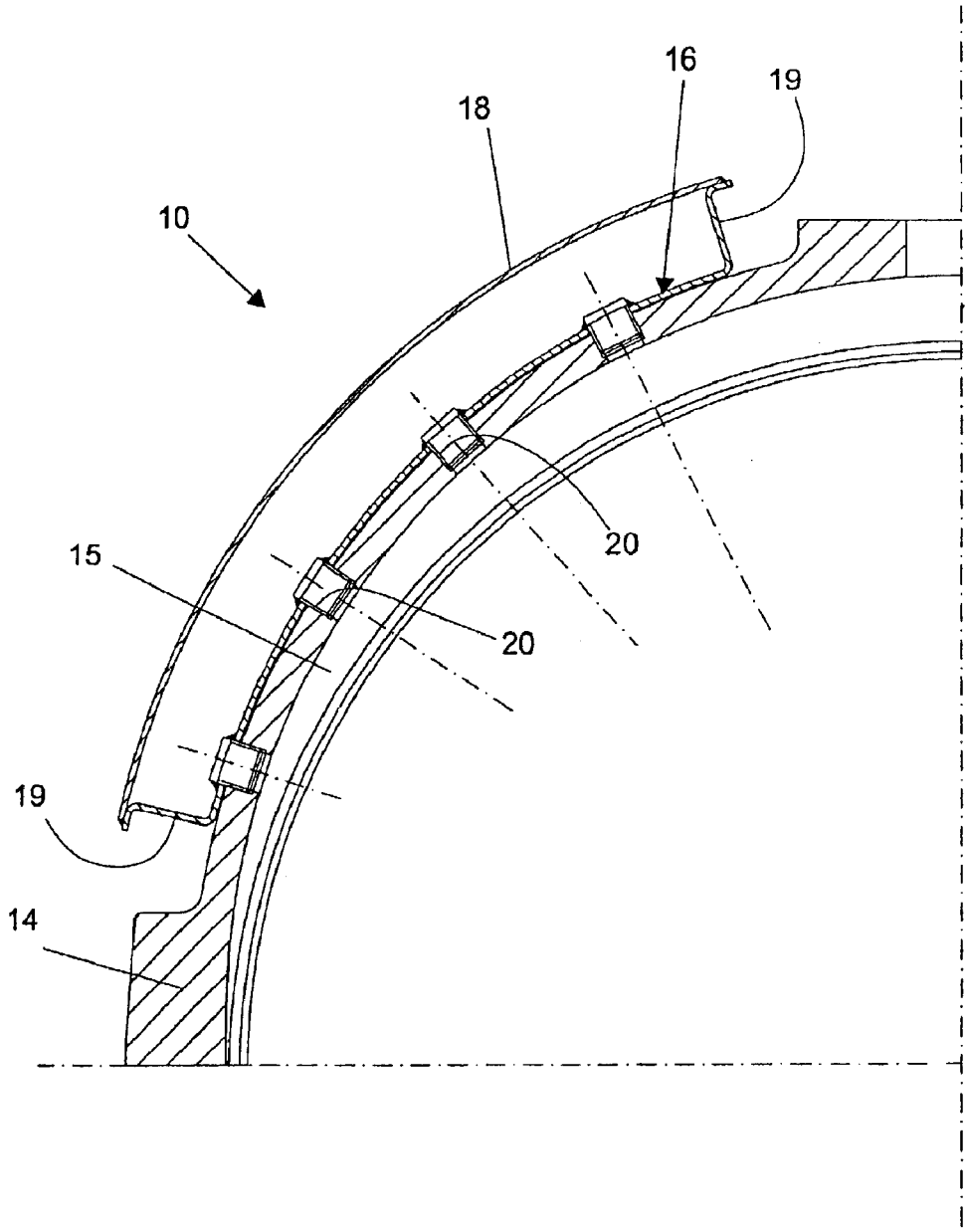
FIG. 2 is a sectional plan view from above of a portion of the casing of FIG. 1, where the process gas extraction device is shown in section.

There are four of the collecting structures 12 in the example shown in the figures (although only one is shown in FIGS. 1 and 2, which are partial plan views of the casing 14 of the compressor), and they are positioned at equal intervals around the casing 14 of the compressor.

Each collecting structure 12 comprises a sheet metal box: the material and thickness of the sheet are compatible with the stresses imposed by the pressures and temperatures present during operation.

Figure 4:
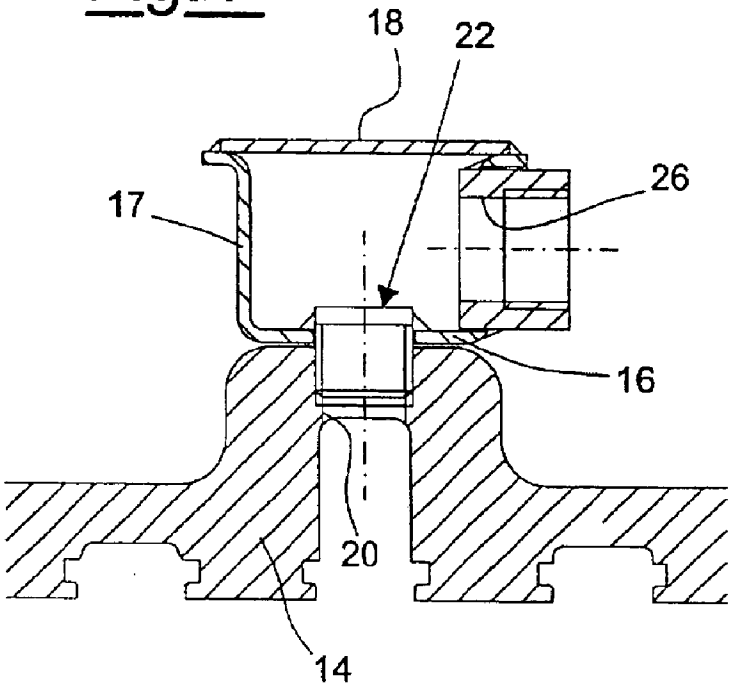
FIG. 4 is a radial section through FIG. 1, taken at the position of a piercing in the casing of the axial compressor.
Figure 3:
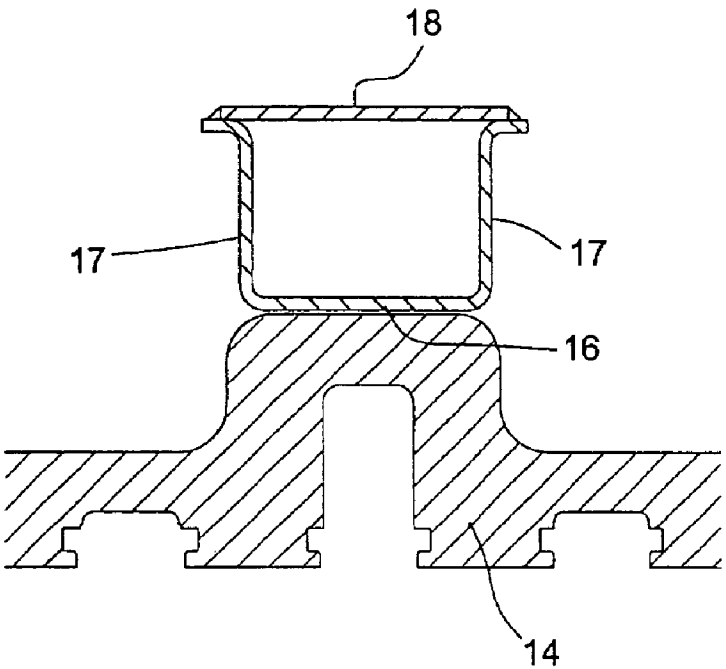
FIG. 3 is a radial section through FIG. 1.

The box can be formed by joining a base portion 16 to a cover portion 18. As shown in FIGS. 3 and 4, the base portion 16 is formed by bending an essentially rectangular sheet on two opposite sides to form two side flanges 17, which extend essentially perpendicularly to the initial sheet. The other two sides are also bent to form two end flanges 19, which are essentially perpendicular to the initial sheet and which have the same length as the side flanges 17. The cover portion 18, also made from metal sheet, is placed on the two side flanges 17 and the two end flanges 19 to close the box.

The base portion 16 is curved in such a way that the sheet on the opposite side to the cover portion 18 follows the outer profile of the casing 14, and is then placed against it in a complementary way. More precisely, each collecting structure 12 is fitted externally to the casing 14 at the position of the collecting volute 15.

The base portion 16 has a series of holes; after the base portion has been placed against the casing 14, piercings 20 are made in the casing 14 of the compressor, with diameters identical to those of the holes of the base portion 16.

The piercings 20, as shown in FIG. 2, are through holes opening into the collecting volute 15 present in the casing 14 of the compressor. These piercings 20 are threaded in such a way that the base portion 16 can be fixed by the insertion of externally threaded bushes 22.

In at least one side flange 17 of the base portion 16 there are outlet holes 26, connected by tubes and connectors to an external anti-pumping control valve.

The operation of the process gas extraction device 10 for an axial compressor which has a high degree of adaptability to a change in the operating characteristics of the compressor, according to the present invention, has been made clear by the above description with reference to the figures, and is briefly as follows.

The base portion 16 is fixed to the casing 14 by means of the bushes 22 which are screwed into the piercings 20 formed in the casing 14 in such a way that one end of each bush is left proud of the base portion 16.

At this point, this end of the bush 22 is welded to the surrounding surface of the said base portion 16, in order to ensure complete prevention of leaks and slackening of the joint between the bush 22 and the piercing 20.

The cover portion 18 is joined to the base portion 16, for example by welding to the edges of the side flanges 17 and to the edges of the end flanges 19.

In practice, four sealed collecting structures 12 are created, forming a collector for connection to the anti-pumping control valve.

The process gas extraction device 10 according to the present invention provides an air extraction capacity which is no longer related to the sonic outflow limits of any extraction channels present in the original casting of the casing 14: this is because the extraction is due to the possibility of adding piercings 20 in the body of the casing 14, thus avoiding a costly replacement of the whole casing 14 if it becomes necessary to modify the operating conditions of the axial compressor.

The above description clearly indicates the characteristics of the process gas extraction device for an axial compressor which has a high degree of adaptability to a change in the operating characteristics of the compressor, according to the present invention, and also clearly indicates the corresponding advantages, of which we may mention:

the simplicity of manufacture;

the minimal costs of adaptation to new operating characteristics of the axial compressor;

the reliable operation.

Finally, it is clear that the process gas extraction device for an axial compressor, which has a high degree of adaptability to a change in the operating characteristics of the compressor and is designed in this way, can be modified and varied in numerous ways within the scope of the invention; furthermore, all the components can be replaced by technical equivalent elements. In practice, the materials used, as well as their shapes and dimensions, can be adapted in any way to meet technical requirements.

The scope of protection of the invention is thus delimited by the attached claims.

What is claimed is:

1. In an axial compressor, a process gas extraction device for the axial compressor, having a high degree of adaptability to changes in the operating characteristics of the compressor, a compressor casing having a volute for collecting process gas, and collecting structures each including a box connected to the said collecting volute for communication therewith.

2. An extraction device according to claim 1, wherein each of the said collecting structures comprises a sheet metal box.

3. An extraction device according to claim 2, wherein said box is made by joining a base portion to a cover portion.

4. An extraction device according to claim 3, wherein said base portion is made by bending a sheet of substantially rectangular shape on two opposite sides to form two side flanges, which extend substantially perpendicularly with respect to said initial sheet, two remaining sides of said sheet being bent to form two end flanges, which are substantially perpendicular with respect to said initial sheet and which have the same length as said side flanges.

5. An extraction device according to claim 4, wherein said cover portion is located on top of said two side flanges and said two end flanges.

6. An extraction device according to claim 3, wherein said base portion is curved such that the sheet located opposite the cover portion follows an external profile of said casing.

7. An extraction device according to claim 6, wherein each collecting structure is located against an outside of said casing at the position of said collecting volute.

8. An extraction device according to claim 7, wherein said base portion has a series of holes, piercings at the positions of said holes in said casing of said compressor, the diameters of the piercings being identical to those of the holes in said base portion.

9. An extraction device according to claim 8, wherein said piercings are through holes opening into said collecting volute present in the casing of the compressor.

10. An extraction device according to claim 9, wherein said piercings are threaded, said base portion being fixed to said casing by externally threaded bushes.

11. An extraction device according to claim 4, wherein at least one of said side flanges of said base portion includes outlet holes, connected by tubes and connectors to an external anti-pumping control valve.

12. An extraction device according to claim 10, wherein said bushes are screwed into said piercings formed in the casing such that one end of each bush is left proud of the base portion, said end of each bush being welded to the surrounding surface of said base portion.

13. An extraction device according to claim 4, wherein said cover portion is joined to said base portion by welding to the edges of the said side flanges and to the edges of said end flanges.

14. An extraction device according to claim 1, including four of said collecting structures positioned at equal intervals around said casing of said compressor.

15. In an axial compressor, a process gas extraction device for the axial compressor, having a high degree of adaptability to changes in the operating characteristics of the compressor, a compressor casing having a volute for collecting processed gas and collecting boxes located against and outside of said compressor casing at the position of said collecting volute and in communication with said collecting volute for avoiding pumping of the compressor during unstable operation of the compressor.

* * * * *